US007090264B2

(12) United States Patent
Dzurko et al.

(10) Patent No.: US 7,090,264 B2
(45) Date of Patent: Aug. 15, 2006

(54) METHOD AND APPARATUS FOR PROVIDING SECUREMENT IN A DOOR LATCH

(75) Inventors: Thomas A. Dzurko, El Paso, TX (US); Ian Dow, Royal Oak, MI (US)

(73) Assignee: Delphi Technologies, Inc., Troy, MI (US)

( * ) Notice: Subject to any disclaimer, the term of this patent is extended or adjusted under 35 U.S.C. 154(b) by 196 days.

(21) Appl. No.: 10/704,424

(22) Filed: Nov. 7, 2003

(65) Prior Publication Data

US 2005/0046199 A1 Mar. 3, 2005

Related U.S. Application Data

(60) Provisional application No. 60/498,633, filed on Aug. 28, 2003.

(51) Int. Cl.
*E05B 9/00* (2006.01)

(52) U.S. Cl. ..... 292/337; 292/201; 292/216; 292/341.12; 292/DIG. 56; 292/DIG. 73

(58) Field of Classification Search ..... 292/337, 292/201, 216, 341.12, DIG. 56, DIG. 73
See application file for complete search history.

(56) References Cited

U.S. PATENT DOCUMENTS

| | | | | |
|---|---|---|---|---|
| 4,358,141 | A * | 11/1982 | Hamada | 292/216 |
| 4,854,617 | A | 8/1989 | Hayakawa et al. | 292/216 |
| 4,911,488 | A * | 3/1990 | Brackmann et al. | 292/216 |
| 4,969,673 | A | 11/1990 | Portelli et al. | 292/216 |
| 5,277,461 | A | 1/1994 | Dzurko et al. | 292/216 |
| 5,316,354 | A | 5/1994 | Arabia, Jr. et al. | 292/340 |
| 5,454,608 | A | 10/1995 | Dzurko et al. | 292/216 |
| 5,520,426 | A | 5/1996 | Arabia, Jr. et al. | 292/337 |
| 5,535,607 | A | 7/1996 | Dzurko et al. | 70/237 |
| 5,715,713 | A | 2/1998 | Aubry et al. | 70/277 |
| 6,264,253 | B1 * | 7/2001 | Takaishi | 292/216 |
| 6,749,234 | B1 * | 6/2004 | Bruce | 292/216 |

FOREIGN PATENT DOCUMENTS

| | | |
|---|---|---|
| DE | 313447 | * 10/1918 |
| EP | 0784140 B1 | 1/2003 |
| GB | 2226849 | * 11/1990 |

* cited by examiner

*Primary Examiner*—Brian E. Glessner
*Assistant Examiner*—Carlos Lugo
(74) *Attorney, Agent, or Firm*—Scott A. McBain

(57) ABSTRACT

A method and apparatus for limiting the movement of a fork bolt when it is in a locking position. The apparatus comprising a latch mechanism for use with a striker, the latch mechanism comprising: a housing being configured to movably receive a fork bolt therein, the fork bolt traveling from an open door position to a closed door position to a locked door position, the fork bolt engaging the striker as the fork bolt moves from the open door position to the closed door position and the locked door position; a protrusion disposed on a surface of the housing, the protrusion having a length corresponding to the movement of the fork bolt from the open door position to the closed door position and the locked door position, the protrusion gradually increasing in height from the surface along the length wherein the protrusion makes contact with the fork bolt as the fork bolt travels from the open door position to the closed door position and the locked door position and movement of the fork bolt.

13 Claims, 8 Drawing Sheets

METHOD AND APPARATUS FOR PROVIDING SECUREMENT IN A DOOR LATCH

CROSS REFERENCE TO RELATED APPLICATIONS

This application claims the benefit of U.S. provisional application Ser. No. 60/498,633 filed Aug. 28, 2003, the contents of which are incorporated herein by reference thereto.

TECHNICAL FIELD

The present disclosure relates to vehicle door latches and more particularly the present disclosure relates to an apparatus and method for providing pawl securement in a door latch.

BACKGROUND

A typical vehicle is manufactured with a plurality of openable doors. Each door is typically mounted on hinges within a door opening. Each door also includes a latch that generally engages a striker mounted on the door opening frame to releasably hold the door in a closed position.

Vehicle door latches customarily include a lock mechanism that prevents operation of the door latch so that the vehicle door cannot be opened by persons inside the vehicle unintentionally or by persons outside the vehicle who are not authorized. The door lock mechanism itself can also be operated from inside as well as from outside the vehicle.

The door lock mechanism is usually operated from inside the vehicle by a slide or a sill button that is actuated manually and/or electrically. The door lock mechanism is usually operated from outside the vehicle by a key and key lock cylinder or an electronic device.

When a door is fully closed to its primary latched position a fork bolt engages a striker disposed on a frame or other appropriate location of the vehicle. When the fork bolt is in this position the door remains secured in the closed position by the engagement of the striker by the fork bolt. It is desirable to limit the play, tolerance or amount of movement of the fork bolt within the latching mechanism when the same is in this locking position.

SUMMARY

An apparatus and method for restricting the movement of a fork bolt in a latching mechanism of a vehicle door. The apparatus comprising a latch mechanism for use with a striker, the latch mechanism comprising: a housing being configured to movably receive a fork bolt therein, the fork bolt traveling from an open door position to an intermediary closed door position to a locked door position, the fork bolt engaging the striker as the fork bolt moves from the open door position to the closed door position and the locked door position; a protrusion disposed on a surface of the housing, the protrusion having a length corresponding to the movement of the fork bolt from the open door position to the closed door position and the locked door position, the protrusion gradually increasing in height from the surface along the length wherein the protrusion makes contact with the fork bolt as the fork bolt travels from the open door position to the closed door position and the locked door position and movement of the fork bolt.

A bolt for use in a latch mechanism for securing a vehicle door by engaging a striker of the vehicle, the latch mechanism having a housing and a face plate, the bolt being rotationally received within an area defined by the housing and the face plate, the bolt comprising: a first protrusion disposed on a first side of the bolt; a second protrusion disposed on a second side of the bolt, the first protrusion and the second protrusion each being configured to limit the tolerances of the bolt with respect to the housing and the face plate as the bolt rotates from a closed door position to a locked door position within the area defined by the housing and the face plate, the bolt engaging the striker as the fork bolt moves from an open door position to the closed door position and the locked door position, the first protrusion having a length corresponding to the movement of the fork bolt from the open door position to the closed door position and the locked door position, the first protrusion gradually increasing in height from the first surface along the length wherein the first protrusion makes contact with the housing as the bolt travels from the open door position to the closed door position and the locked door position, the second protrusion having gradually a length corresponding to the movement of the fork bolt from the open door position to the closed door position and the locked door position, the second protrusion gradually increasing in height from the second surface along the length wherein the second protrusion makes contact with the face plate as the bolt travels from the open door position to the closed door position and the locked door position.

A method for controlling the movement of a fork bolt within a housing of the latch mechanism, the latch mechanism being configured to engage a striker, the method comprising: disposing a protrusion on a surface of the housing, the protrusion having a configuration corresponding to rotational movement of the fork bolt within the housing, the protrusion gradually increasing in height from the surface from a first position to a second position, the fork bolt being configured to rotate within the housing in a range defined by an open door position at one end, an intermediary closed door position and a locked door position at the other end, the protrusion engaging the fork bolt at the closed door position and movement of the fork bolt with respect to the housing is limited at the locked door position wherein a maximum height of the protrusion engages a surface of the fork bolt.

DETAILED DESCRIPTION

This disclosure relates to an apparatus and method for restricting the movement of a bolt or fork bolt in a latching mechanism of a vehicle door. In order to open and close a door the fork bolt travels from an open position to an intermediary second position and a primary locked position. This range of movement causes the fork bolt to engage and latch the latching mechanism to a striker associated with the door. In an exemplary embodiment, a protrusion or ramp having a gradually increasing height engages or makes contact with a surface of the fork bolt as it rotates into its primary latched position. The contact between the protrusion and the fork bolt limits the movement or tolerance of the fork bolt when the latching mechanism is fully engaged upon the striker. Thus, vibrations of the latch assembly will not affect or move the fork bolt when it is in the primary position.

Figure 1:
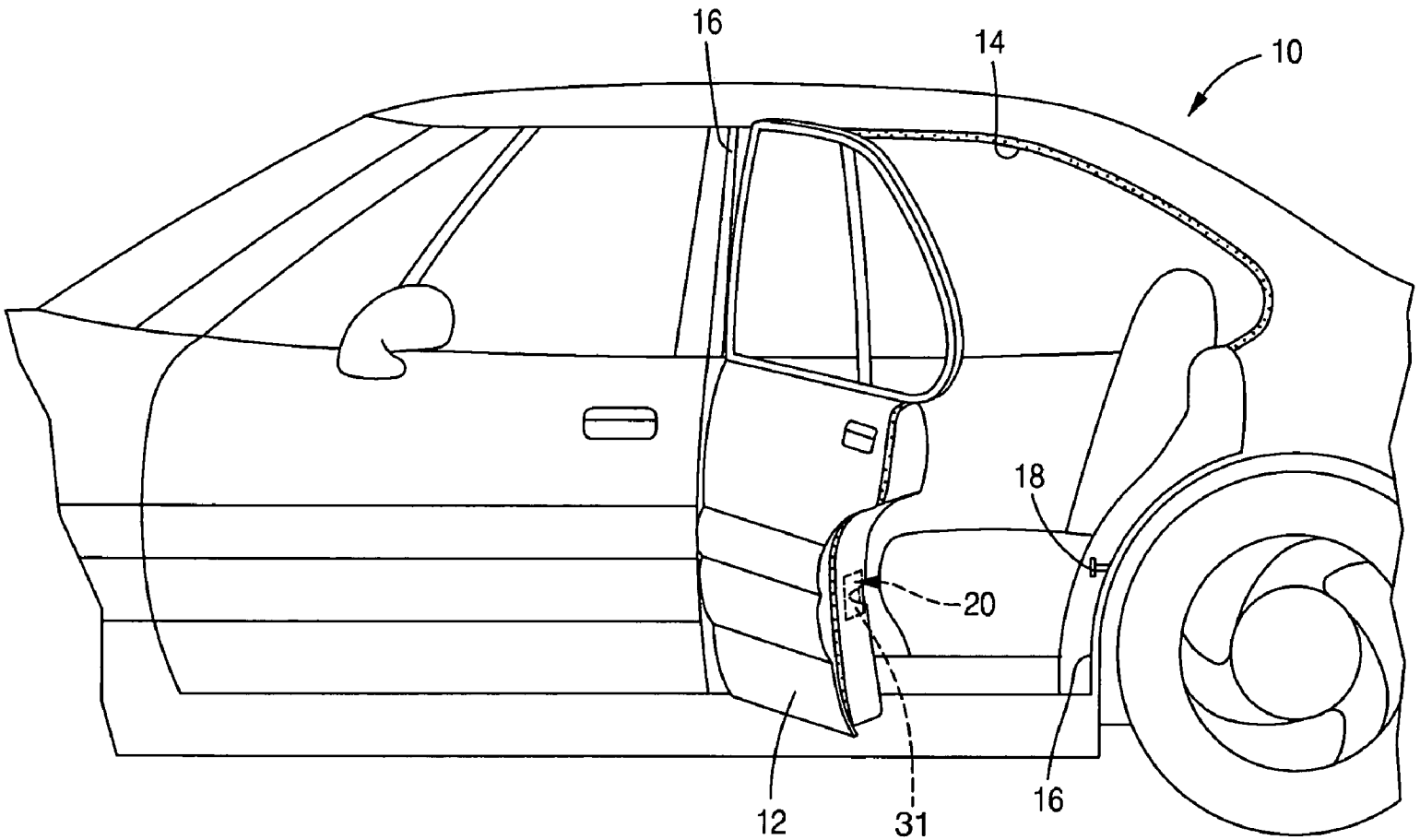
FIG. 1 is a partial illustration of a vehicle with a door having a latching mechanism.

FIG. 1 illustrates a vehicle designated generally as 10. Vehicle 10 has at least one door 12 movably received within a door opening 14. Opening 14 is surrounded by a frame 16 which includes a striker 18. Striker 18 is fixedly mounted on the frame or a pillar panel. The striker extends from the frame into the door opening wherein the striker is engaged by a door latch mechanism 20. Engagement of the striker by the latch mechanism occurs as the door moves from an open position to a closed position and vice versa.

Figure 4:
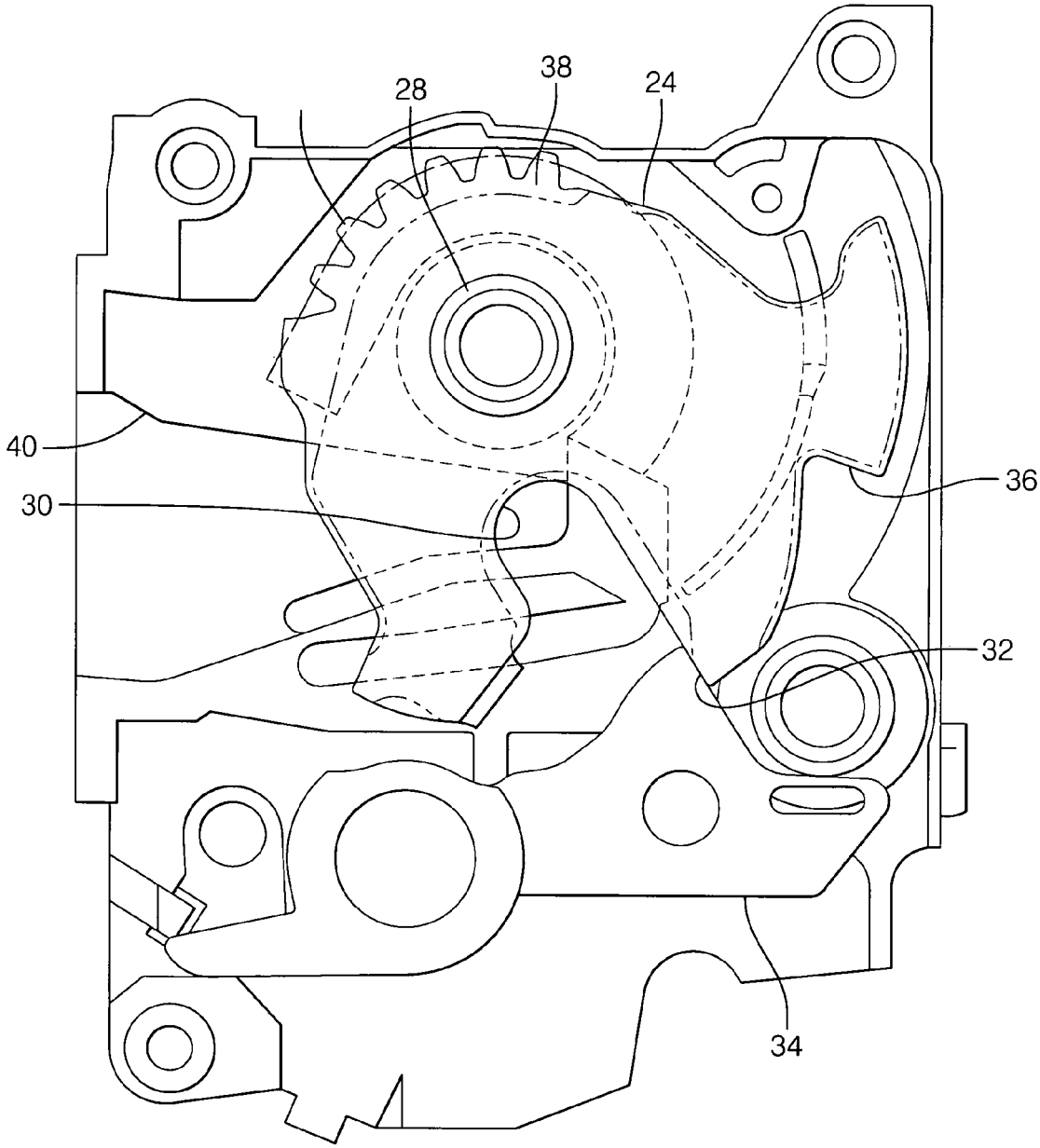
FIGS. 4–6 are views illustrating component parts of a latching mechanism constructed in accordance with an exemplary embodiment of the present invention in a primary or a locked position.
Figure 5:
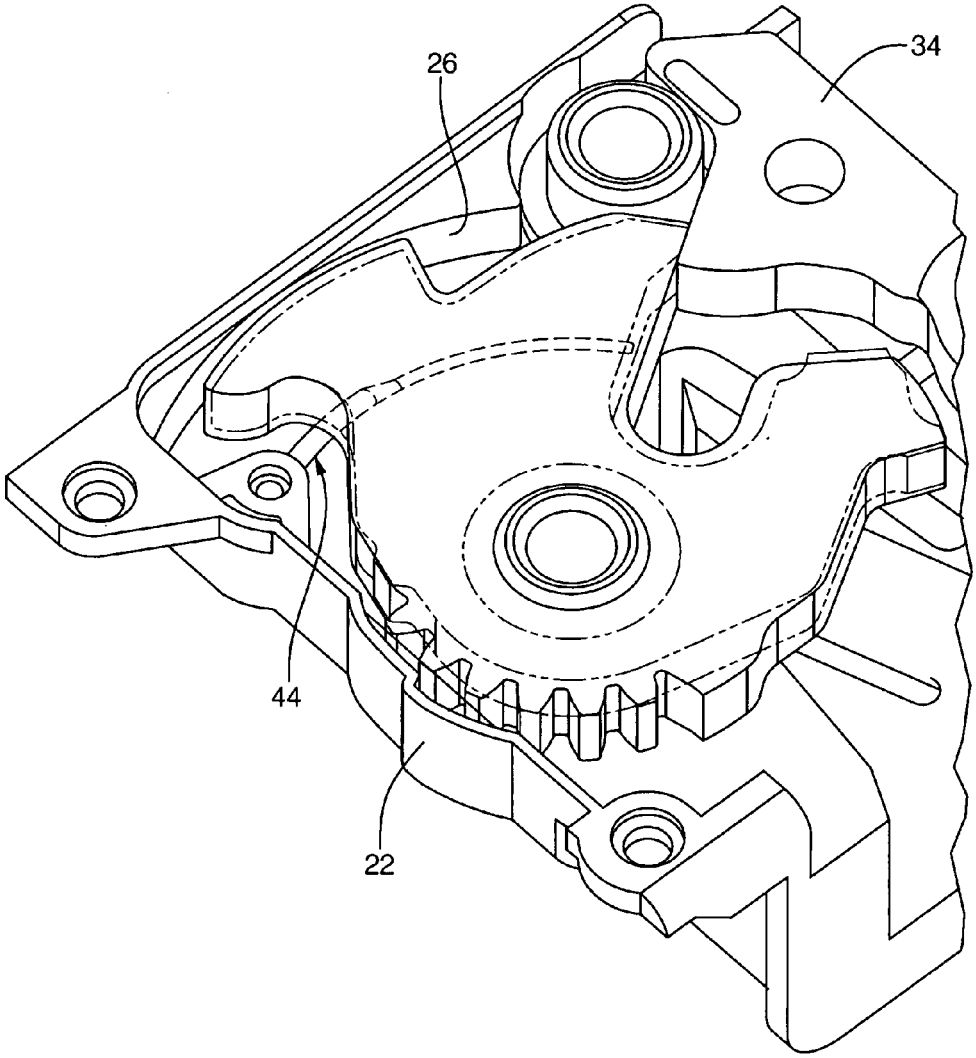
Figure 6:
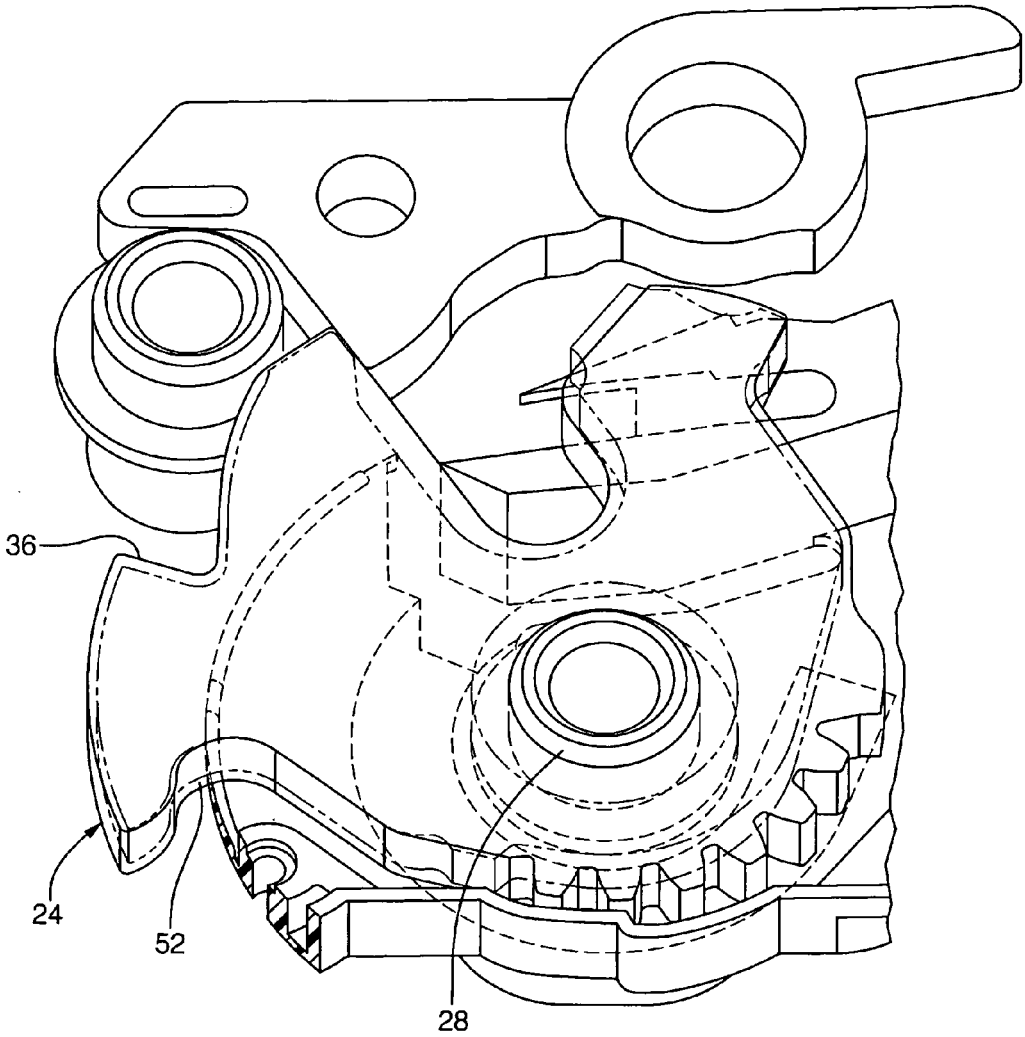

During opening and closing of the door and the resulting engagement of the striker by the latch mechanism, the latch mechanism moves between a primary (FIGS. 4, 5, 6) e.g., door closed latching mechanism engaging striker, a secondary (FIGS. 7 and 8) e.g., door closed but striker not fully locked into the closed position and a fully open position (not shown) wherein the striker is released from latching mechanism and the door is able to be opened by an individual. In the fully open position the striker is able to freely move away from the latch mechanism.

More detailed explanations of vehicle door latch operations and various alternative configurations are found in U.S. Pat. Nos. 5,520,426; 5,277,461; 5,316,354; 5,454,608; 4,969,673; and 5,715,713 the contents of which are incorporated herein by reference thereto.

Referring now to FIGS. 2–8, and in accordance with exemplary embodiments of the present invention components of latching mechanism 20 are illustrated in greater detail. For ease of explanation and understanding, all of the components of a vehicle door latching mechanism are not illustrated and detailed explanations and illustrations of vehicle door latch operations and configurations are found in previously mentioned United States Patents incorporated by reference.

Particular components corresponding to exemplary embodiments of the present invention are adaptable to the teachings of any of the aforementioned patents as well as equivalent devices.

Figure 2:
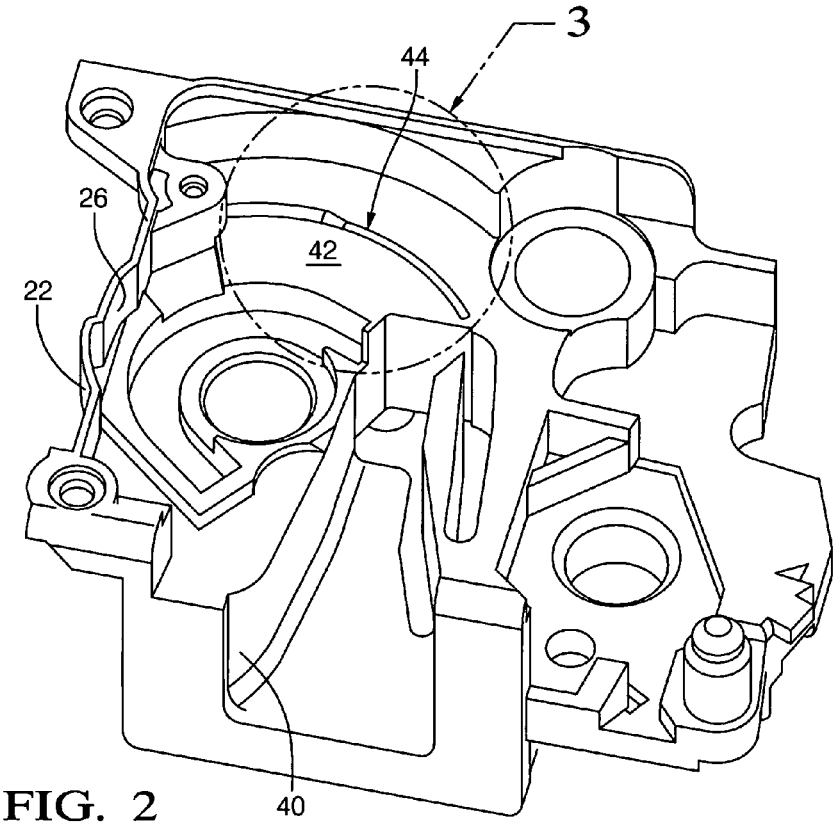
FIG. 2 is a perspective view of a latching mechanism for use in a vehicle door.
Figure 3:
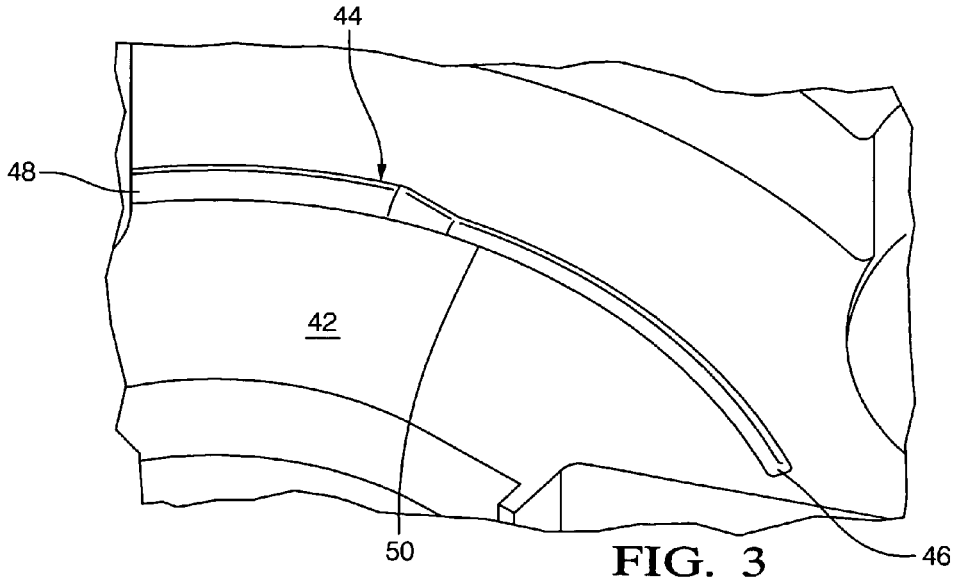
FIG. 3 is an enlarged view of a portion of the housing illustrated in FIG. 2.

As illustrated in FIGS. 2 and 3, latch mechanism 20 comprises a housing 22 configured to movably receive a bolt or as commonly referred to in the related arts a fork bolt 24. In an exemplary embodiment housing 22 is molded out of a plastic material. Of course, other equivalent materials are considered within the scope of the present invention. Fork bolt 24 is positioned within a receiving area 26 configured to receive fork bolt 24. Receiving area 26 is configured to allow fork bolt 24 to travel between the primary, secondary and fully open positions and vice versa.

Fork bolt 24 is pivotally mounted on a pin 28 in order to allow for such movement. Fork bolt 24 includes an aperture or receiving area 30, which receives and engages striker 18 as the vehicle door is closed. The closing of the vehicle door results in engagement between the striker and the fork bolt. A face plate or cover 31 (FIG. 1) is disposed over fork bolt 24 after it has been inserted and secured within receiving area 26. In accordance with an exemplary embodiment fork bolt 24 is manufactured out of steel. Of course, other equivalent materials are considered within the scope of the present invention.

Figure 7:
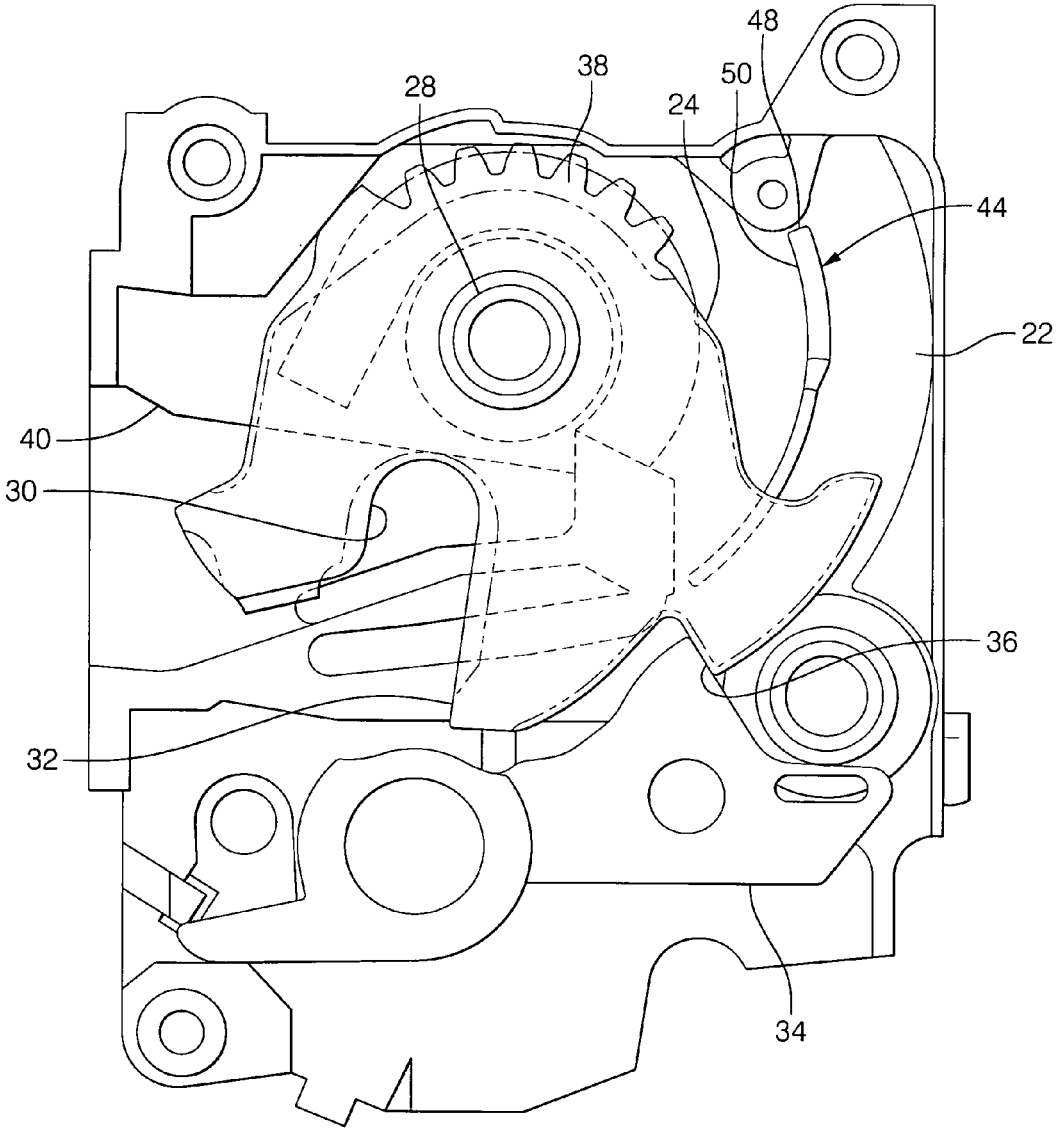
FIG. 7 and 8 are views illustrating component parts of a latching mechanism constructed in accordance with an exemplary embodiment of the present invention in a secondary or not-fully engaged position.
Figure 8:
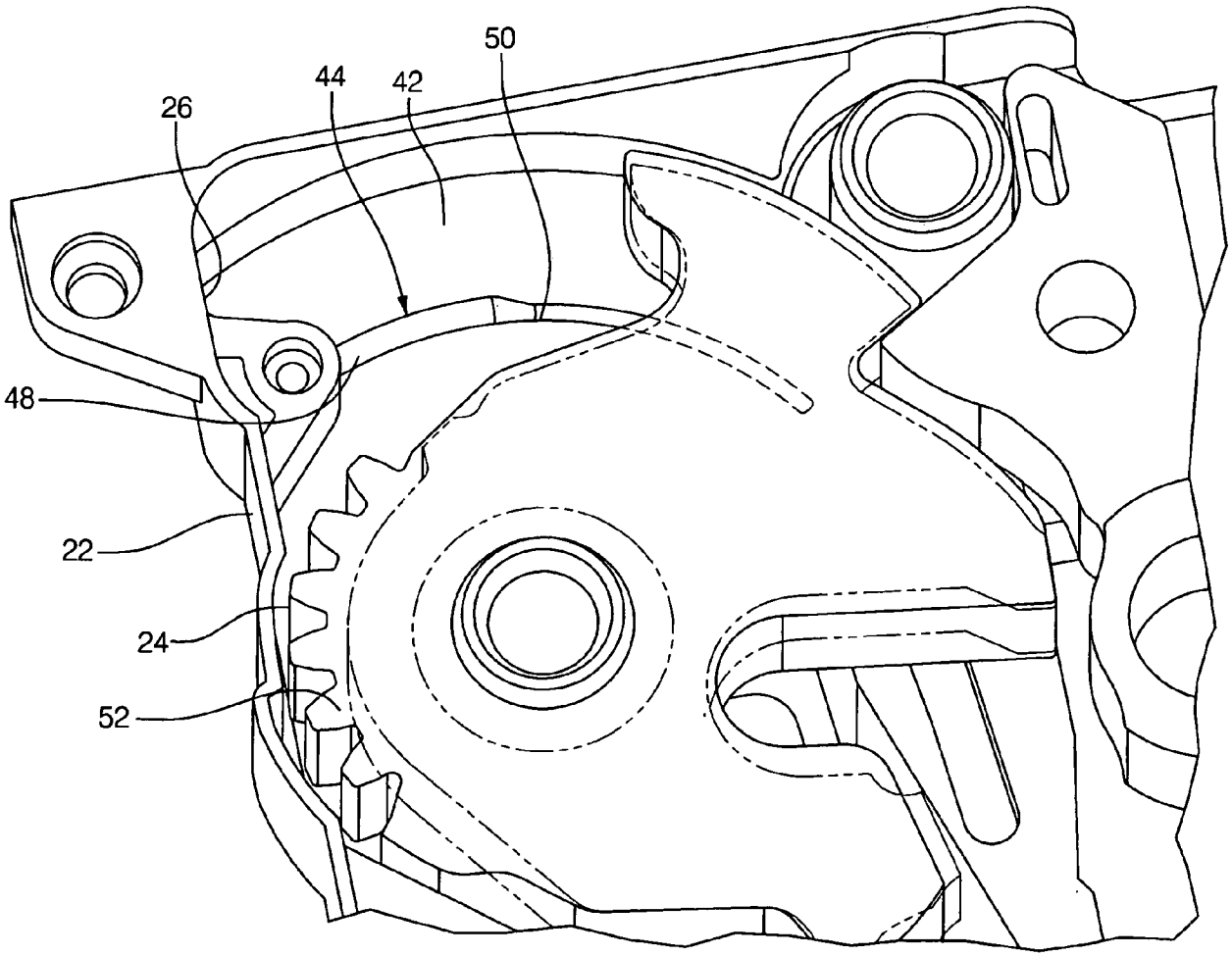

During closing of the door, engagement of the striker results in rotation of fork bolt 24 from the open position to the secondary position (FIGS. 7 and 8) and ultimately the primary position (FIGS. 3, 4 and 5) as striker 18 enters aperture 30 and an engagement portion 32 captures striker 18. Closing of the door results in rotation of fork bolt 24 between the open unlatched position and ultimately the fully closed primary latched position shown in FIGS. 3, 4 and 5. When in the fully closed primary latched position, bolt 24 is held against rotation back into the open position by detent lever 34, which engages portion 32 of fork bolt 24. In the secondary position, the detent lever 34 engages a shoulder portion 36 of fork bolt 24. This position is shown in FIGS. 7 and 8.

In order to provide this operation the fork bolt lever and the cooperating detent lever are pivotally mounted on bushings located in a chamber of the plastic housing behind the metal face plate. The fork bolt lever is biased by a coil spring or equivalent biasing member (not shown) and the detent lever is biased in an opposite direction by another biasing member (not shown) with respect to the fork bolt. Operation of the detent lever and release of the same is at least found in U.S. Pat. Nos. 5,520,426; 5,277,461; 5,316,354; 5,454,608; 4,969,673; and 5,715,713.

In addition, and in accordance with an exemplary embodiment fork bolt 24 is constructed out of steel wherein a portion thereof is over molded with a layer of plastic or SANTOPRENE type of material (e.g., thermoplastic elastomers (TPEs) or equivalents thereof) 38. Layer 38 is used to prevent vibration of the fork bolt as the vehicle is traveling. In addition, layer 38 will have a low coefficient of friction, which assists in the movement of fork bolt 24 within receiving area.

During closing of the door the latching mechanism operates as follows, when the door latch is in an unlatched and unlocked condition the fork bolt lever is poised to receive a conventional striker that projects into an aligned slot or opening 40 of the housing and/or the face plate when the door is shut. The entering striker engages the fork bolt and rotates the fork bolt against the bias of the spring until the fork bolt is rotated into the full latch position shown in FIGS. 3, 4 and 5. The fork bolt lever is held in the full latch position by the detent lever engaging the primary latch shoulder of the fork bolt.

Referring now to FIGS. 2–8, a surface 42 of receiving area 26 is configured to have a protrusion 44 which extends along a path on surface 42. In an exemplary embodiment, the path of protrusion 44 has an arc-like configuration that mimics the pivotal movement of the fork bolt as it is engaging the striker. Of course, it is understood that many other configurations of the path of protrusion 44 are contemplated in accordance with exemplary embodiments of the present invention and the same is not to be limited to those illustrated in the attached figures.

The protrusion comprises a profile that gradually increases in height from a first end 46 to a second or opposite end 48. The first end having little or no distance from surface 42 and the second end 48 having a maximum distance from surface 42. In addition, disposed therebetween is an intermediary height corresponding to a position 50, which as will be discussed herein provides an initial point of contact between protrusion 44 and a surface of fork bolt 24. In an exemplary embodiment, protrusion 44 also comprises plastic or a SANTOPRENE type of material (e.g., thermoplastic elastomers (TPEs) or equivalents thereof) that is over molded onto surface 42 of housing 22. Alternatively, protrusion 44 is molded integrally with the material of housing 22 (e.g., the profile of protrusion 44 is in the mold for forming housing 22). Also, fork bolt 24 has a layer of encapsulation 52 (e.g., plastic or SANTOPRENE type of material (e.g., thermoplastic elastomers (TPEs) or equivalents thereof)).

The height of protrusion 44 from surface 42 or gradual increase in height is configured to provide little or no contact between a surface of fork bolt 24 and a surface of protrusion 44 when fork bolt 24 is in a position that aligns opening 30 with opening 40. Moreover, contact is not made until fork bolt 24 is in the secondary position illustrated in FIGS. 7 and 8 at this point, position 50 of protrusion 44 will begin to make contact with a surface of fork bolt 24. At this point, and as fork bolt 24 rotates from the secondary position to the primary position increasing contact is made between protrusion 44 and a surface of fork bolt 24. Once fork bolt 24 has reached the primary position illustrated in FIGS. 4–6, protrusion 44 will limit tolerances (e.g., movement of fork bolt 24 within housing 22 in directions other than the pivotal movement of the fork bolt in the housing) thereby providing a closely fitting arrangement between fork bolt 24 and housing 22 and a face plate (not shown) which is disposed on top of fork bolt 24. Furthermore, and in accordance with exemplary embodiments the interference (e.g., height of protrusion from surface 42) between protrusion 44 and fork bolt 24 is sufficient to limit tolerances while still allowing fork bolt 24 to easily move from the primary position to either the secondary or open position by the urging forces biasing member when detent 34 is no longer engaging fork bolt 24.

Accordingly, and as fork bolt 24 moves from an open position (not shown) the gradually increasing height of protrusion 44 causes contact between the fork bolt and housing which begins at the second position and increases with force as the fork bolt moves to the primary position. This increasing contact will prevent the fork bolt from vibrating at unwanted frequencies within the structure in which the latching mechanism is installed is vibrating.

In addition, since there is little or no contact between fork bolt 24 and protrusion 44 as the fork bolt travels from the open position to the secondary position the tolerances (e.g., movement of the fork bolt with respect to the housing in directions other than the rotational movement of the fork bolt) are at a maximum in order to allow for ease of movement of the fork bolt as it initially engages the striker. In accordance with an exemplary embodiment the width of protrusion 44 is 4.0 mm and the height of the protrusion is 0.5 mm above the surface of the housing at its highest point (e.g., position 48). In addition, and in accordance with an exemplary embodiment the configuration of protrusion 44 resembles an arc having a radius of 20.0 mm from the center of the bushing on which fork bolt 24 rotates. It is, of course, understood that the aforementioned dimensions and configurations of protrusion 44 are provided as examples and the present invention is not intended to be limited by the same.

In an exemplary embodiment protrusion 44 is disposed on surface 42 of housing 22. In an alternative embodiment, another complementary protrusion 44 is disposed on the face plate covering fork bolt 24. The face plate covers the fork bolt when it is received within the area of housing. In this embodiment a pair of protrusions (one on surface 42 and one on a surface of the face plate covering the fork bolt) engage either side of the fork bolt.

Figure 9:
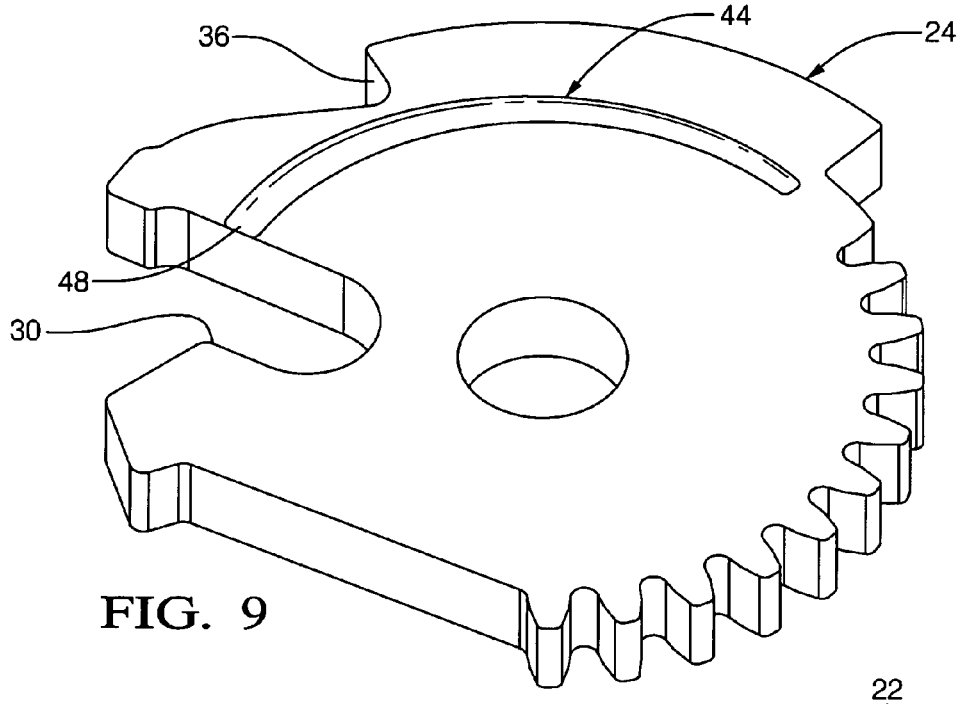
FIG. 9 is a perspective view of a component part of an alternative embodiment of the present invention.

Referring now to FIG. 9 another alternative exemplary embodiment is illustrated. In this embodiment, the fork bolt 24 is configured to have protrusion 44 instead of housing 22 and/or the face plate of the housing. In this embodiment, the protrusion is on either one side or both sides of fork bolt 24 wherein protrusion 44 makes contact with a surface of the housing and/or the face plate in accordance with the positions as discussed above. In accordance with this embodiment, fork bolt 24 is manufactured out of steel and is partially over-molded with an encapsulating layer of santoprene or other material as discussed above. Here protrusion 44 is disposed on top of layer 52. Accordingly, as fork bolt 24 rotates within housing 22 the protrusion makes contact with the housing in accordance with the rotational positions of the fork bolt discussed above.

Figure 10:
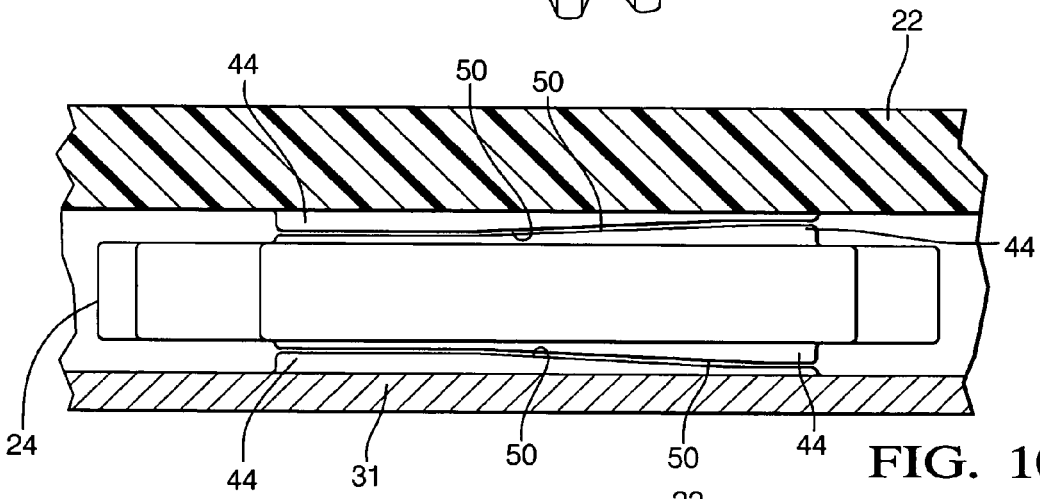
FIG. 10 is an end view of another exemplary embodiment of the present invention.

Referring now to FIG. 10 another exemplary embodiment is illustrated wherein the teachings of the previous embodiments are combined. Here a first pair of interlocking ramps are disposed between the fork bolt and a surface of the housing and a second pair of interlocking ramps are disposed between the fork bolt and a facing surface of the faceplate disposed in spatial relationship with respect to the fork bolt.

Figure 11:
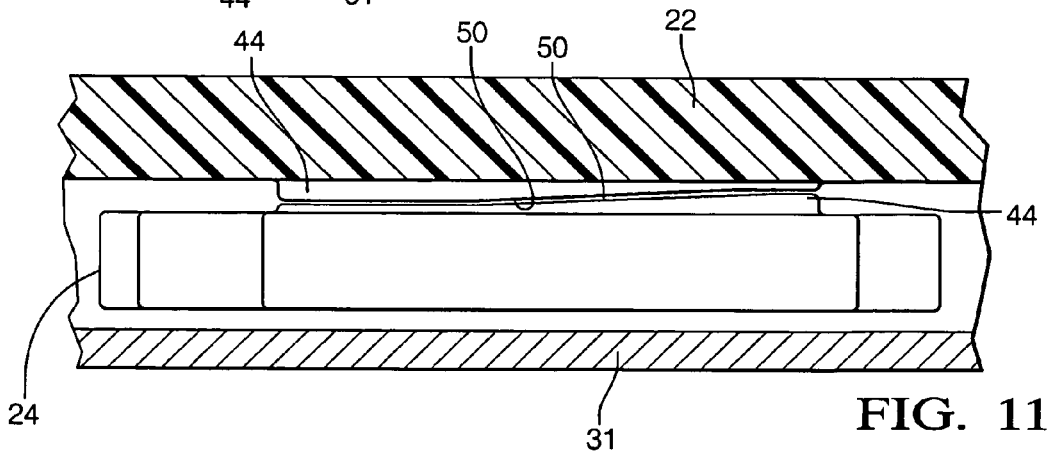
FIG. 11 is an end view of another exemplary embodiment of the present invention.

Alternatively, only one pair of interlocking ramps are disposed between either the fork bolt and a surface of the housing or the fork bolt and a surface of the faceplate. For example, one such arrangement is illustrated in FIG. 11. In either of these embodiments the interlocking ramps rise upwardly and away from their respective surfaces (e.g., the surface upon which they are disposed) in opposite directions. Accordingly, and as the fork bolt rotates through the positions discussed herein the pairs of interlocking ramps begin to make contact with each other in interlocking fashion as the fork bolt moves from the open position to the secondary position wherein position 50 of a protrusion on the fork bolt makes contact with a corresponding position 50 on the protrusion of the housing and/or the faceplate. Thus, contact begins at the secondary position and increases as the fork bolt moves or rotates to the primary position.

It is noted that the fork bolt is illustrated in a non-protrusion engaging position (e.g., between open and secondary) in FIG. 10. The arrangement and application of the protrusions in this embodiment are similar to those of the previous embodiments.

In accordance with exemplary embodiments of the present invention, latching mechanism 20 is contemplated for use with tailgates, vehicle doors and any other application vehicular are or otherwise wherein a striker is engaged by a fork bolt of any latching mechanism wherein ramping profiles on either the fork bolt or the housing in which the fork bolt is movably received.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the present application.

What is claimed is:

1. A latch mechanism for securing a vehicle door by engaging a striker of the vehicle, the latch mechanism comprising:

a housing a face plate spaced apart from the housing;

a fork bolt movably received between said housing and said face plate, said fork bolt being capable of traveling between an open door position, a closed door position and a locked door position, said fork bolt engaging the striker as said fork bolt moves from the open door position to the closed door position;

a first protrusion disposed on a surface of said housing, said first protrusion having a length corresponding to the movement of the fork bolt from the open door position to the closed door position and the locked door position, said protrusion gradually increasing in height from said surface along said length wherein said protrusion makes contact with the fork bolt as the fork bolt travels from the open door position to the closed door position and the locked door position; and a second protrusion disposed on a surface of the face plate, said second protrusion having a length corresponding to the movement of the fork bolt from the open door position to the closed door position and the locked door position, said second protrusion gradually increasing in height from said face plate along said length wherein said second protrusion makes contact with the fork bolt as the fork bolt travels from the open door position to the closed door position and the locked door position, said first protrusion and said second protrusion each make initial contact with said fork bolt when said fork bolt is in the closed door position; and wherein tolerances between said fork bolt, said housing and said face plate are minimized as said fork bolt moves from the closed door position to the locked door position, and wherein said fork bolt further comprises a pair of protrusions disposed on said fork bolt such that one is disposed on one side of said fork bolt and the other is disposed on another side of said fork bolt, said pair of protrusions each having a length corresponding to the movement of the fork bolt from the open door position to the closed door position and the locked door position, said pair of protrusions gradually increasing in height from said fork bolt along said length and said pair protrusions being configured to engage said first protrusion and said second protrusion in an interlocking fashion wherein said pair of protrusions increase in height in an opposite direction with respect to said first protrusion and said second protrusion.

2. The latch mechanism as in claim 1, wherein the closed door position and the locked door position correspond to the striker being engaged by a receiving area of the fork bolt and a detent lever engages shoulder portions of said fork bolt as said fork bolt travels from the open door position to the closed door position and the locked door position.

3. The latch mechanism as in claim 2, wherein tolerances between said fork bolt and said housing and said face plate are at a maximum when said fork bolt is in the open door position.

4. The latch mechanism as in claim 1, wherein said first protrusion is integral with said housing and comprises an arcuate configuration with respect to an axis of rotation of said fork bolt.

5. A bolt for use in a latch mechanism for securing a vehicle door by engaging a striker of the vehicle, the latch mechanism having a housing and a face plate, the bolt being rotationally received within an area defined by the housing and the face plate, the bolt comprising:

a first protrusion disposed on a first side of said bolt;

a second protrusion disposed on a second side of said bolt, said first protrusion and said second protrusion each being configured to limit the tolerances of said bolt with respect to the housing and the face plate as said bolt rotates from a closed door position to a locked door position within the area defined by the housing and the face plate, said bolt engaging the striker as said fork bolt moves from an open door position to the closed door position and the locked door position, said first protrusion having a length corresponding to the movement of the fork bolt from the open door position to the closed door position and the locked door position, said first protrusion gradually increasing in height from said first surface along said length wherein said first protrusion makes contact with the housing as the bolt travels from the open door position to the closed door position and the locked door position, said second protrusion having gradually a length corresponding to the movement of the fork bolt from the open door position to the closed door position and the locked door position, said second protrusion gradually increasing in height from said second surface along said length wherein said second protrusion makes contact with the face plate as the bolt travels from the open door position to the closed door position and the locked door position.

6. The bolt as in claim 5, wherein said first protrusion and said second protrusion are formed from a thermoplastic elastomer material.

7. The bolt as in claim 6, wherein a portion of said bolt is encapsulated by a layer and said first protrusion and said second protrusion are disposed on said layer.

8. The bolt as in claim 5, wherein said first protrusion and said second protrusion each have an arcuate shape having a radius of curvature corresponding to an axis of rotation of said bolt.

9. A method for controlling the movement of a fork bolt within a housing of a latch mechanism, the latch mechanism being configured to engage a striker, the method comprising:

disposing a protrusion on a surface of the housing, said protrusion having a configuration corresponding to rotational movement of the fork bolt within the housing, said protrusion gradually increasing in height from said surface from a first position to a second position, said fork bolt being configured to rotate within the housing in a range defined by an open door position at one end, an intermediary closed door position and a locked door position at the other end, said protrusion engaging said fork bolt at said closed door position and movement of said fork bolt with respect to the housing is limited at said locked door position wherein a maximum height of said protrusion engages a surface of said fork bolt;

disposing a complimentary protrusion of a surface of the fork bolt wherein the protrusion disposed on the fork bolt increases in height in an opposite direction with respect to the protrusion disposed on said surface of said housing; and disposing another protrusion on another surface of the fork bolt and disposing a complimentary protrusion for said another protrusion on a surface of a face plate of the latch mechanism wherein said another protrusion and said complimentary protrusion for said another protrusion each increase in height in opposite directions with respect to each other.

10. The method as in claim 9, wherein said protrusions each have an arcuate configuration having a radius of curvature defined with respect to an axis of rotation of the fork bolt.

11. The method as in claim 10, wherein said fork bolt engages the striker as said fork bolt travels from said open door position to said locked door position.

12. A method for controlling the movement of a fork bolt within a housing of a latch mechanism, the latch mechanism being configured to engage a striker, the method comprising:

disposing a first protrusion on a first surface of the fork bolt, said first protrusion gradually increasing in height in a first direction; and disposing a second protrusion on a second surface of the fork bolt, said second protrusion gradually increasing in height in said first direction;

wherein said first protrusion is configured to engage a surface of the housing and said second protrusion is configured to engage a surface of a face plate of the housing as said fork bolt rotates from an open door position to a locked door position.

13. The method as in claim 12, further comprising:

disposing a third protrusion on said housing, said third protrusion gradually increasing in height in a second direction wherein said first protrusion and said third protrusion engage each other in an interlocking fashion when said fork bolt rotates from an open door position to a locked door position; and disposing a fourth protrusion on said face plate, said fourth protrusion gradually increasing in height in said second direction wherein said second protrusion and said fourth protrusion engage each other in an interlocking fashion when said fork bolt rotates from an open door position to a locked door position, wherein said second direction is opposite to said first direction.

* * * * *